US007575797B2

(12) United States Patent
Karr et al.

(10) Patent No.: US 7,575,797 B2
(45) Date of Patent: Aug. 18, 2009

(54) BLAST REDUCING STRUCTURES

(75) Inventors: Dale Karr, Milan, MI (US); Marc Perlin, Ann Arbor, MI (US)

(73) Assignee: The Regents Of The University Of Michigan, Ann Arbor, MI (US)

( * ) Notice: Subject to any disclaimer, the term of this patent is extended or adjusted under 35 U.S.C. 154(b) by 723 days.

(21) Appl. No.: 11/211,367

(22) Filed: Aug. 25, 2005

(65) Prior Publication Data

US 2006/0042115 A1 Mar. 2, 2006

Related U.S. Application Data

(60) Provisional application No. 60/605,386, filed on Aug. 27, 2004, provisional application No. 60/639,395, filed on Dec. 22, 2004.

(51) Int. Cl.

| | |
|---|---|
| ***B32B 1/00*** | (2006.01) |
| ***B32B 3/10*** | (2006.01) |
| ***E04C 2/34*** | (2006.01) |
| ***F41H 5/02*** | (2006.01) |

(52) U.S. Cl. ..... 428/137; 428/116; 428/178; 89/36.02; 52/793.1

(58) Field of Classification Search ..... 428/34.1, 428/72, 116, 120, 137, 178, 911; 52/790.1, 52/793.1; 89/36.01, 36.02

See application file for complete search history.

(56) References Cited

U.S. PATENT DOCUMENTS

| | | | | |
|---|---|---|---|---|
| 4,348,442 | A | 9/1982 | Figge | |
| 5,131,174 | A * | 7/1992 | Drew et al. | 36/35 B |
| 6,200,664 | B1 | 3/2001 | Figge et al. | |

OTHER PUBLICATIONS

Ali K. El Wahed et al.; Materials & Design; *Electrorheological and magnetorheological fluids in blast resistant design applications*; 2002.

S. Guruprasad et al.; International Journal of Impact Engineering; *Layered sacrificial claddings under blast loading, Part I—analytical studies*; 2000.

* cited by examiner

*Primary Examiner*—Donald Loney
(74) *Attorney, Agent, or Firm*—Harness, Dickey & Pierce, P.L.C.

(57) ABSTRACT

A blast reducing structure having a first web and a second web. Each of the webs having a first section defining a first plane, a second section defining a second plane, the second plane being generally parallel to the first plane, an interconnecting section interconnecting the first section to the second section. The first web is disposed in mirrored relationship to the second web to define a volume. An energy absorbing liquid is disposed in the volume, such that the first section, the second section, and the interconnecting section cooperate to collapse in response to an impact pulse, thereby dissipating force associated with the impact pulse. Alternate volumes may be air-filled so as to accept the expelled liquid.

21 Claims, 9 Drawing Sheets

Δ=0.0 cm. (a)

Δ=1.91 cm. (b)

Δ=2.54 cm. (c)

Δ=3.43 cm. (d)

Δ=4.62 cm. (e)

Δ=5.18 cm. (f)

BLAST REDUCING STRUCTURES

CROSS-REFERENCE TO RELATED APPLICATIONS

This application claims the benefit of U.S. Provisional Application No. 60/605,386, filed on Aug. 27, 2004 and U.S. Provisional Application No. 60/639,395, filed on Dec. 22, 2004. The disclosures of the above applications are incorporated herein by reference.

FIELD

The present teachings relates to blast reducing structures and, more particularly, relates to a blast reducing structure having a liquid-structure-based assembly.

BACKGROUND

Blast reducing structures are becoming increasingly desired for use in protecting items of value from the effects of blast waves. Blast waves, such as those produced in response to explosions or other dramatic events, can often cause damage to items of value, such as buildings, vehicles, homes, or other structures. Buildings and homes are typically not designed to withstand the generally horizontally-disposed blast waves, but instead are designed to withstand the vertical structural forces and typical environmental forces.

The threat from bomb blasts is increasing in recent years. In fact, recently the Bureau of Alcohol, Tobacco, Firearms and Explosives (ATF) reported a total of 2,667 bombing incidents in the United States alone for the four year period from 2000 through 2003. These incidents include attempted, actual, and accidental explosions—with actual bombings far exceeding attempts and accidental explosions. As is widely known, domestic and international bombings that have targeted the United States and its citizens have included the World Trade Center, Murrah Federal Building, Khobar Towers, and U.S. Embassies in Kenya and Tanzania. It is clear that bombing attacks aimed at the United States and its citizens represent a serious and, unfortunately, growing threat.

In the past decade, bombing attacks against buildings and their occupants utilizing large vehicle-bombs have become more frequent world wide, and hundreds of smaller bombing attacks against buildings and people have occurred. The magnitude and likelihood of the threat posed for a specific building depends on the building's mission and location. Therefore, in addition to natural and technological hazards, designers of public structural systems must now confront the prospects of bomb blasts that are intended to destroy and/or kill. Comprehensive protection against the full range of possible threats is impossible. However, it is desirable that levels of protection that reduce the risk of mass casualties are developed.

Accordingly, there exists a need in the relevant art to provide a structure that is capable of reducing the harmful forces associated with blast waves. Furthermore, there exists a need in the relevant art to provide a blast reducing structure that can be used to protect items of value, such as buildings and the like, from blast waves. Still further, there exists a need in the relevant art to provide a blast reducing structure that provides increased shielding capability without a substantial increase in mass or overall size. Finally, there exists a need in the relevant art to provide a blast reducing structure that is capable of overcoming the limitations of the prior art.

SUMMARY

According to the principles of the present teachings, a blast reducing structure is provided having advantageous construction. The blast reducing structure includes a first web and a second web. Each of the webs having a first section defining a first plane, a second section defining a second plane, the second plane being generally parallel to the first plane, an interconnecting section angularly interconnecting the first section to the second section. The first web is disposed in mirrored relationship to the second web to define a volume. An energy absorbing liquid is disposed in the volume, such that the first section, the second section, and the interconnecting section cooperate to collapse in response to an impact pulse, thereby dissipating energy associated with the impact pulse.

Further areas of applicability of the present teachings will become apparent from the detailed description provided hereinafter. It should be understood that the detailed description and specific examples, are intended for purposes of illustration only and are not intended to limit the scope of the teachings.

BRIEF DESCRIPTION OF THE DRAWINGS

The present teachings will become more fully understood from the detailed description and the accompanying drawings, wherein:

FIG. 4(*b*) is a cross-sectional view illustrating the web according to some embodiments;

DETAILED DESCRIPTION

Figure 1:
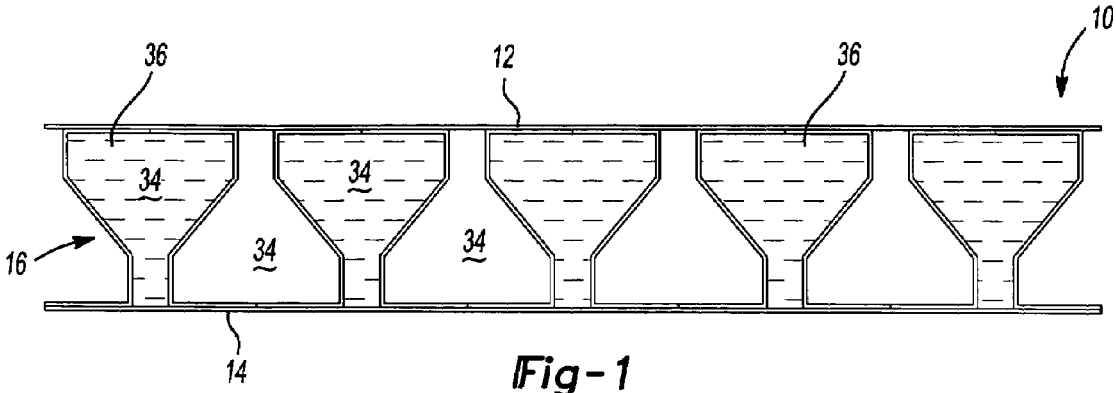
FIG. 1 is a cross-sectional view illustrating a blast reducing structure.

The following description of the preferred embodiment is merely exemplary in nature and is in no way intended to limit the teachings, its application, or uses.

In 1997, the Defense Threat Reduction Agency initiated The Blast Mitigation for Structures Program to improve the performance of buildings that are targets of bombing attacks. This program, also sponsored by the Technical Support Working Group, was undertaken to develop technology to reduce injuries and deaths to people in buildings through blast mitigation techniques.

To resist blast loads, these and other studies have clearly shown that the first requirement in the assessment of a structure is to determine the threat. Two equally important elements 1) the bomb size or charge weight, and 2) the standoff distance (i.e. the minimum distance between the blast source and the target) define the threat of a conventional bomb. The peak blast pressures decay as a function of the distance from the blast source as the expanding shock waves decrease in intensity with range. The duration of the positive pressure phase of the wave increases with range, resulting in a lower-amplitude and longer duration shock pulse for structures situated farther from the explosions. Charges situated extremely close to a target impose high intensity pressure loads over a localized region of the structure. For close proximity bombs, even smaller charges can cause locally intense damage, leading to failure of critical load carrying structural elements. This may also cause major building damage by progressive collapse.

Thus, defensive design has two critical factors: limiting the size of the bomb and maximizing standoff distances. Vehicle control and inspections seek to keep large bombs at considerable distances. The standoff distance and the assumed size of the explosive device infer the type of blast resistant features that must be provided. To provide a basis for risk assessment and design, the information used to define the blast loads, including size and distance, must be established and addressed accordingly. An exclusion or "keep-out" zone is created typically by the use of courtyards and plazas, utilizing perimeter bollards, planters, fountains and other barriers that prevent vehicles from getting too close to the target buildings. The exclusion distance is vital in the design of blast resistant structures since it is the key parameter that determines, for a given charge weight, the pressures encountered by the buildings.

Powerful explosions release a large amount of energy in a very short time. Part of the energy is released as heat and part as a shock wave that travels through the air and the ground. The air blast radiates at supersonic speed from the explosion source with the pressure wave decreasing in intensity with distance from the source. Upon encountering a structure, the blast wave subjects the surfaces to the local pressure of the blast. Immediately after an explosion, the pressure increases very rapidly to a peak value. Relative to the time scales used for describing the pressure's decay and the time scales of the structural response, the time to peak pressure can be treated as instantaneous. As the pressure decays and interacts with the structure, extensive damage to structures and people occur. The dynamics of the blast pressure wave propagation and the structural response often occur on the order of milliseconds.

Catastrophic damage often occurs due to the enormous amounts of energy of the explosion. Resistance of structures to blast effects requires the use of massive elements that are large and ductile enough to survive without failure. The concept of "graceful failure" requires that various elements will resist long enough to absorb a large amount of energy and then fail in a manner that minimizes the risk of serious injury or death to those nearby.

Both the intensity of the blast pressures and their duration greatly influence their effect on structures. Massive structural components provide inertial resistance, which tends to reduce the amount of structural resistance required. While the strength of these structures is critical to their response, their ability to deform inelastically in a ductile fashion will limit the forces that can be resisted. The design and detailing of structural elements make it possible for the structure to deform in a ductile manner to prevent a catastrophic brittle failure and allow for timely evacuation of the facility. Localized hardening of vulnerable structural elements and improving robustness through ductile detailing of systems will improve resistance to more extensive blast damage.

Blast resistant structures have been very important in military applications as well as many industrial settings, such as chemical and nuclear facilities where structures are at risk to accidental explosions. Traditional structures, even those designed to withstand large blast forces, employ the use of plates and shells made of solid walls. Larger blasts call for heavier armor, usually implying heavy metal or concrete walls.

For local blast protection, incorporation of innovative combinations of advanced, high strength materials are often required to contain the energy of a blast. In many cases, the preferred structure may be a sandwich panel with faceplates made from multilayer material stacks as it combines lightweight with tailored structural rigidity. The hollow structures of the sandwich panel may be filled with a lightweight material with high damping characteristics for blast absorption. However, the impulse pressures imparted to the absorbing substructure must be minimized while simultaneously the energy absorbing capacity must be maximized. Order of magnitude improvements are sought in energy management and energy absorption capacity per unit mass of substructure/materials.

There are two main structural design considerations used to mitigate these blast effects—structural design redundancies and exterior facade protection systems. Application of the principles of the present teachings falls under the latter category; however, it is anticipated that application of the physics set forth herein could lead to applications for design redundancy as well.

Design redundancies are structural arrangements and modifications used to prevent catastrophic collapse of a building. These redundancies allow for redirection of load paths after portions of a building have been destroyed as a result of an attack. Effective design redundancies prevent progressive collapse of the damaged building and increase the chance of successful rescue operations.

When a localized failure causes adjoining members to be overloaded and fail, progressive collapse causes damage that is disproportionate to the originating localized failure. Transfer girders and columns are particularly vulnerable to blast loading. Loss of girders and columns create much larger spans and loads on the remaining structures, this in turn leaves these systems subject to additional failure that can lead to a propagation of failure of the entire structure. New facilities may be designed to accept the loss of an exterior column for one or more floors without precipitating collapse. Redundant load paths should be provided in anticipation of damage occurring due to localized failure.

Upgrading existing structures to prevent localized damage from causing a progressive collapse may be very difficult because different types of connection details may be required as well as alternative paths of reinforcement. This may prove very costly as well as interfere with the function of the existing building. Vulnerable concrete columns may be jacketed with steel plates or composite materials. Steel columns may be encased in concrete to protect their cross sections and add mass. These approaches to prevent progressive collapse are generally more feasible in retrofits than attempting to supplement the capacity of connecting beams and girders. Hence, protective systems such as those set forth herein, are suitable for retrofit and may be very valuable for reducing risk of existing buildings.

The cost of protection increases dramatically with the assumed charge weight to the point at which the cost of protection becomes untenable. The engineer must design and detail specific components to withstand the various threats so that catastrophic failure and progressive collapse are avoided. The recognition of the localized intensity of the close-in blast and the inability to design the entire structure to withstand this type of loading is the first step in prescribing forces to be withstood. The details of the loading pressures, impulses, and durations for a variety of explosives are fairly well established. However, the problem remains as to just what type of threat should be established for design and redesign purposes. This places a premium on protective systems that are flexible and scalable, such as those set forth herein.

Apparatus

The principles of the present teachings involve specially tailoring the structure, substructure, or microstructure of materials to absorb energy from blast and impact pressures and thus protect items and personnel from the effects of explosions, projectiles, and other impacts. The materials and structures are to be constructed, possibly in layers, such that within the material or substructures are cells, compartments, volumes, or chambers with geometry to allow collapse in particular patterns. Selected cells contain liquid or deformable materials, such as smart liquids or materials, which are constrained initially but flow upon rupture from impact pressures and thus dissipate energy. Thus, upon impact, energy is absorbed by elastic and plastic structural collapse and, in addition, by combinations of liquid-structural friction, internal energy release such as heat and phase transformations, momentum transfer, and viscous damping. That is, the liquid contributes to blast-effects mitigation by providing increased initial mass to the resisting system, by direct dissipation of energy through viscosity and liquid flow, and by redirecting the momentum imparted to the system from the blast impulse pressures. Lastly, the presence of the liquid with large capacity for heat absorption will help to reduce thermal problems experienced with blasts.

With particular reference to FIG. 1, a blast reducing structure 10 is illustrated in accordance with the principles of the present teachings. Blast reducing structure 10 includes an optional top face 12, an optional bottom face 14, and a plurality of webs 16 operably disposed between top face 12 and bottom face 14 to form an energy absorbing structure. In some embodiments, top face 12 and bottom face 14 are made of generally planar members, such as plate steel. Suitable widths and lengths of the blast reducing structures are to be established based on the environment requiring protection and the blast characteristics. In addition, two or more blast reducing structures 10 may be used in series where required (not shown).

Figure 2:
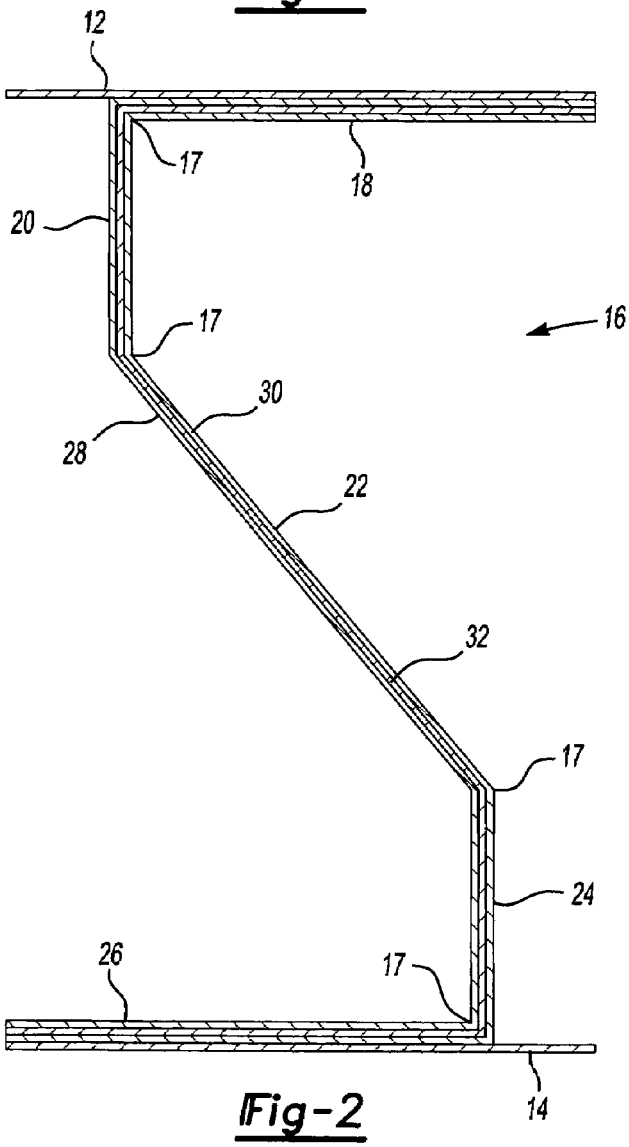
FIG. 2 is a cross-sectional view illustrating a web according to the principle of the present teachings.

In some embodiments, as seen in FIG. 2, each of the plurality of webs 16 can be configured to collapse under loading to absorb energy generated in response to a blast. To this end, each of the plurality of webs 16 can define a modified Z-shape designed to collapse in a mechanism having four hinge points 17 between a first section 18, a second section 20, a third section 22, a fourth section 24, and a fifth section 26. First section 18 and fifth section 26 are each disposed adjacent top face 12 and bottom face 14, respectively, and are in parallel relationship to each other. Second section 20 extends orthogonally from first section 18. Similarly, fourth section 24 extends orthogonally from fifth section 26. Lastly, third section 22 angularly interconnects second section 20 and fourth section 24 to complete the modified Z-shape profile.

As seen in FIG. 2, web 16 can further comprise a multi-layer structure. Specifically, this multi-layer structure can comprise a first layer 28, a second layer 30, and an intermediate layer 32 disposed between and laminated with first layer 28 and second layer 30. It should be appreciated that any number of layers may be used as determined by the specific application, such as designed-for blast strength and standoff distance.

Figure 4A:
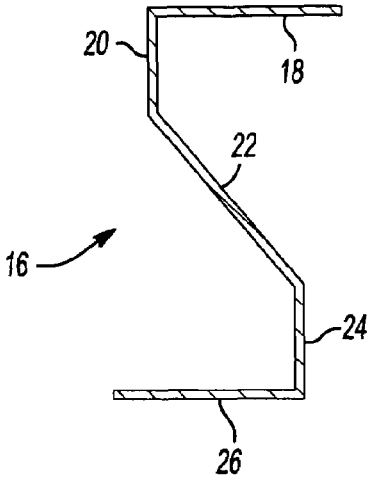
FIG. 4(*a*) is a cross-sectional view illustrating the web according to some embodiments.
Figure 4B:
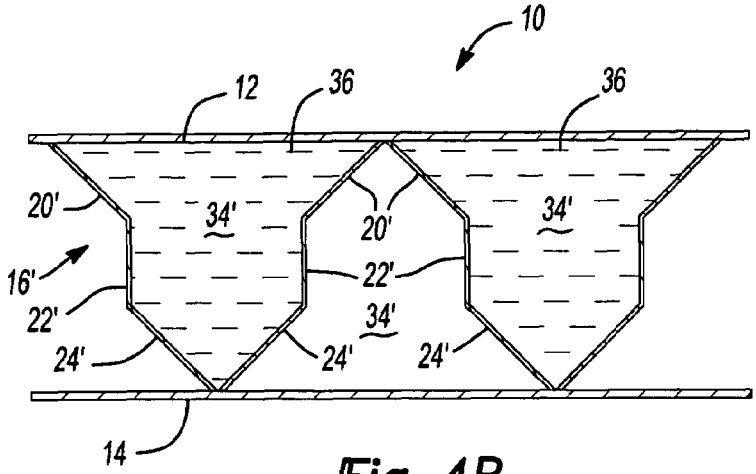
Figure 5:
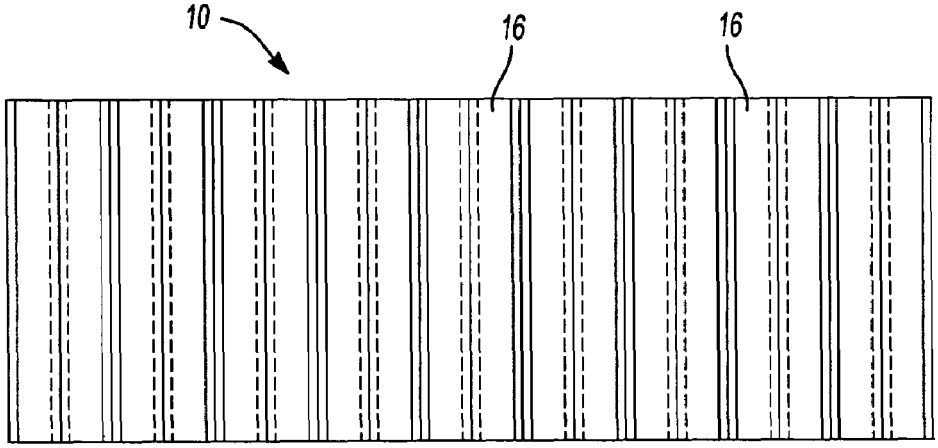
FIG. 5 is a plan view illustrating the blast reducing structure.
Figure 6:
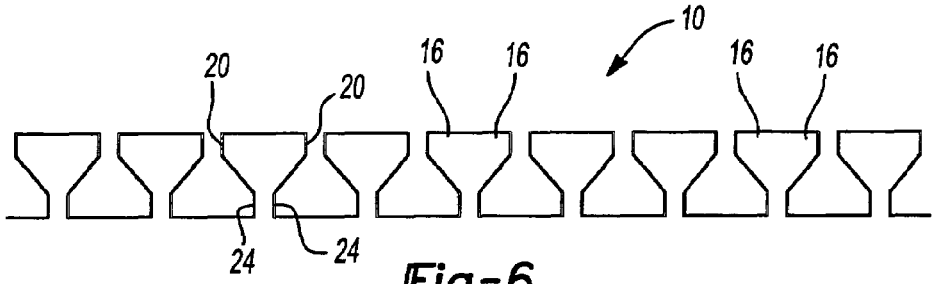
FIG. 6 is a side view illustrating the blast reducing structure with portions removed.
Figure 7:
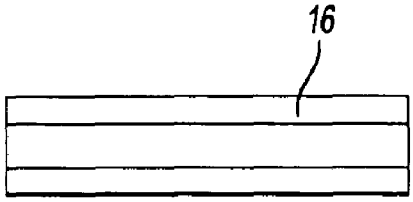
FIG. 7 is a side view illustrating the web.
Figure 8:
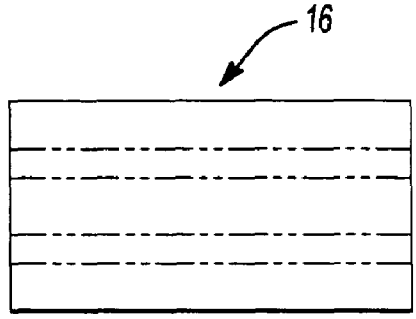
FIG. 8 is a plan view illustrating the web prior to forming.

As seen in FIG. 4(*a*), in some embodiments, web 16 can have a formed structure wherein first section 18 is 1.5 inches long, second section 20 is $^{13}/_{16}{}^{th}$ inch long, third section 22 is 1.82 inches long and is disposed at an angle of 39.29° relative to second section 20, third section 24 is $^{13}/_{16}{}^{th}$ inch long, and fourth section 26 is 1.5 inches long. A distal end of first section 18 can extend beyond a proximal end of fourth section 26 in an X-direction as illustrated in FIG. 4(*a*). Similarly, a distal end of fourth section 26 can extend beyond a proximal end of first section 18 in the X-direction. Therefore, when a plurality of webs 16 are arranged in mirrored arrangement with each other, a funnel shaped volume 34 (FIG. 1) is formed therebetween.

Figure 3:
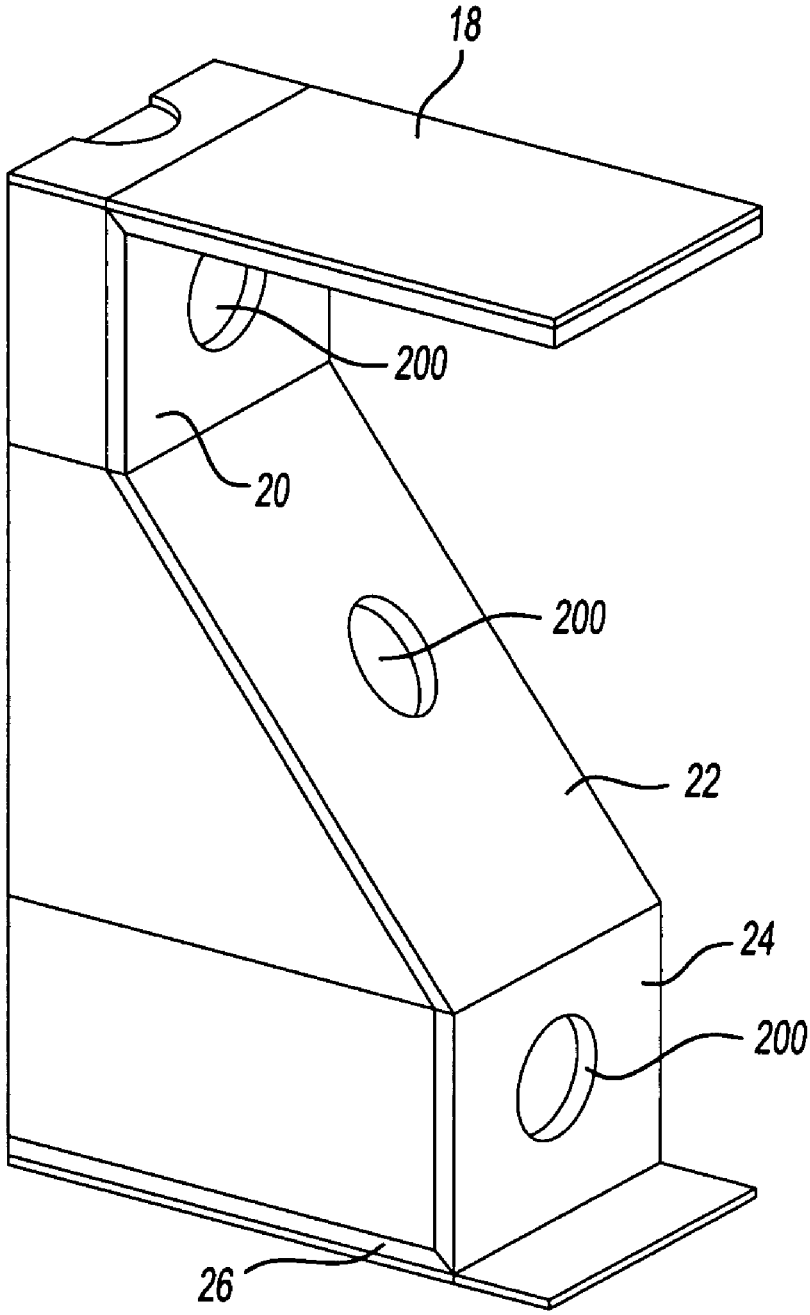
FIG. 3 is a perspective view illustrating one web of the blast reducing structure.

Funnel shaped volumes 34 (FIG. 1) of the plurality of webs 16 may contain liquid or deformable materials 36, possibly smart liquids or materials, which are constrained initially but flow upon rupture from impact pressures. In some embodiments, only some of the plurality of funnel shaped volumes 34 contains liquid 36. For example, alternating ones of the plurality of funnel shaped volumes 34 can contain liquid 36. In fact, any pattern or predetermined arrangement of filled funnel shaped volumes 34 and unfilled funnel shaped volumes 34 may be selected that is conducive to a desired impact pulse response characteristic. Furthermore, in some embodiments, these liquids or deformable materials 36 may flow through apertures 200 (FIG. 3) formed in each of the plurality of webs 16 to further absorb impact energy. Apertures 200 may be disposed in any one or more of the first section 18, second section 20, third section 22, fourth section 24, or fifth section 26 as is desired to achieve the desired energy dissipation. A grommet, plug, or other sealing member may be used to seal the liquid or deformable materials 36 within funnel shaped volumes 34. Liquid or deformable materials 36 can include such materials as water, water with water additives to increase density and viscosity, polydimethylsiloxane (PDMS), water and glycerine mixtures, and granular materials that flow (i.e. sand). However, it should be appreciated that other liquids or deformable materials may be used that are stable, inflammable, and provide the appropriate viscosities, densities, and/or costs.

In some embodiments, as seen in FIG. 4(*b*), blast reducing structure 10 can include top face 12, bottom face 14, a second section 20', a third section 22', and a fourth section 24'. It should be appreciated that in some embodiments, first section 18 and fifth section 26 may be eliminated. Still referring to FIG. 4(*b*), blast reducing structure 10 comprises web 16' having a structure such that second section 20' and fourth section 24' are generally parallel to each other and disposed at an angular relative to top face 12 and bottom face 14, respectively. Third section 22' is disposed at an angle relative to first section 20' and fourth section 24' and generally perpendicular to top face 12 and bottom face 14. Therefore, when a plurality of webs 16' are arranged in mirrored arrangement with each other, a funnel shaped volume 34' (FIG. 4(*b*)) is formed therebetween. As described above, funnel shaped volume 34' is filled is liquid or deformable materials 36. Likewise, as described above, in some embodiments apertures 200 are formed in top face 12, bottom face 14, second section 20', third section 22', and/or fourth section 24'. As will be described in detail herein, during a blast impulse, the present embodiment causes second section 20' to collapse toward top face 12. This collapse motion results in a decrease in volume in an upper portion of funnel shaped volume 34', which leads to an increase in fluid pressure. This increase in fluid pressure is advantageous in resisting the downward movement of top face 12, thereby providing improved impact response.

The physics of this structure and its subsequent response to the large impulsive-like loads imparted by explosions, projectiles, and other impacts may be separated into three primary categories: (1) increased initial mass to reduce initial velocity imparted to the wall; (2) dissipation mechanisms responsible for reducing energy over time; and (3) direction change to the initial momentum. Each of these is discussed herein, with a brief explanation of the advantage yielded by the responses. As mentioned previously, in addition to these three primary benefits, the absorption capacity of the liquid should reduce the thermal effects of the blast.

By filling at least some of the plurality of funnel shaped volumes 34 with liquid or a portion thereof, the mass of blast reducing structure 10 is increased. Hence, the forces from an impact must accelerate initially a larger mass causing a decreased initial velocity compared to an air-filled structure. Adding mass is not novel as it regards blast protection; rather, it is the reason many barriers are simply dense, heavy structures. The problem, however, with these latter structures is that once moving, even with less velocity, since the mass is large, the potential force is huge. It is at this point that the uniqueness of the present teachings is evident. The present teachings involves adding mass to reduce initial velocities, but also provides a means of reducing and redirecting momentum after the onset of deformations caused by the blast pressure.

It is only a matter of milliseconds during which a protective structure must shield. In the present teachings, blast reducing structure 10 provides additional protection in that two separate energy dissipation mechanisms exist—that is, through the use of solids and liquids. As in most structures under large loading, plastic deformation and Coulomb friction at solid-solid interfaces generates dissipative forces; however, in blast reducing structure 10, due to the presence of the liquid enclosed in the interstitial spaces (i.e. funnel shaped volumes 34) of blast reducing structure 10 and retained by a membrane, plug, grommet, tape, or other sealing member that rapidly become plastic or rupture, three additional dissipative forces exist. These forces include viscous friction due to the pressure-generated flow of the liquid over the solid; expansion, fracture, or dislodgement of the sealing members by the liquid and the flow of the viscous liquid through apertures 200 that lead to empty interstitial spaces located between the liquid loaded cavities.

As mentioned above, one last important difference exists between conventional structures and the liquid filled structures of this design. If we consider at the limit of force required by the wall to reflect a blast, in the limit of complete reflection, it is shown easily with elementary physics that twice the momentum is required to reverse the direction of the impact. Likewise, in the limiting case, if we require only that the direction is altered by 90 degrees rather than by 180 degrees as just mentioned, the force required is halved. Though the real problem is much more complicated, these limiting cases serve to illustrate the third benefit of this structural design. By directing liquid flow in a direction perpendicular to the primary blast direction, the downstream force of the blast is decreased significantly. To determine actual benefits of this structure and to optimize the parameters of the problem, preliminary analytical and numerical calculations have been performed.

Design Methodology

Nomenclature:

- A=the average horizontal funnel area times unit depth
- $A_k$=an effective area expressed in terms of stiffener geometry
- $A_w$=the total area of the holes in the section
- $A_1$=liquid contact area with upper structural plate
- $A_2$=horizontal area of the top liquid section
- $\tilde{A}$=effective liquid cross-sectional area
- C=damping coefficient in the Ricatti form of equation
- F=forcing term in the Ricatti form of equation
- $F_c$=compressive force in the stiffener
- $F_i$=initial blast force on the top panel
- $F_o$=static strength of the stiffener
- M=total mass, $M_1+M_k$
- $M_k$=effective mass in terms of liquid and stiffener masses
- $M_1$=mass of upper structural plate
- $M_2$=mass of the top liquid section
- $\tilde{M}$=effective liquid mass
- $p_1$=liquid pressure at the top of the rectangular cell
- $p_2$=liquid pressure at the bottom of the rectangular cell
- q=time rate of change of the blast force dissipation
- t=time
- V=cell volume
- $v_1$=liquid speed at the top of the rectangular cell
- $v_2$=liquid speed at the bottom of the rectangular cell
- $v_{2i}$=liquid speed from the funnel section to the top section
- X=average vertical displacement of the top panel
- $\dot{x}$=average vertical speed of the top panel
- $\ddot{x}$=average vertical acceleration of the top panel
- $\gamma$=a geometric factor
- $\rho$=mass density of the liquid Design of blast and impact resistant structures is a complex task that involves a number of factors before determining an acceptable design. Often, it is desirable, although not required, for the structure to undergo plastic and permanent deformation. Permanent deformation may be desirable if the residual strength of the structure is not undermined and the deformation permits energy absorption capacity. It is also possible to design the structure in layers wherein the layer of the structure subjected to the direct blast undergoes plastic deformation, and hence reduced energy is transmitted to subsequent layers or other portions of the structure. In such a design, the sacrificial layer must perform with a degree of predictability and efficiency for a range of blast loads. The important characteristics of a structure under large plastic deformations are: mode of deformation, impulse transfer, energy absorption, and collapse space efficiency. In some embodiments, it is desirable to choose structural configurations that have a consistent deformation mode throughout the deformation process. The ability to absorb energy and the collapse efficiency depend on the spread of the plastic region in the structure. Finally, the sacrificial layer should transfer the least impulse to the non-sacrificial layers and the components of the structure that the layers are designed to protect.

Figure 9:
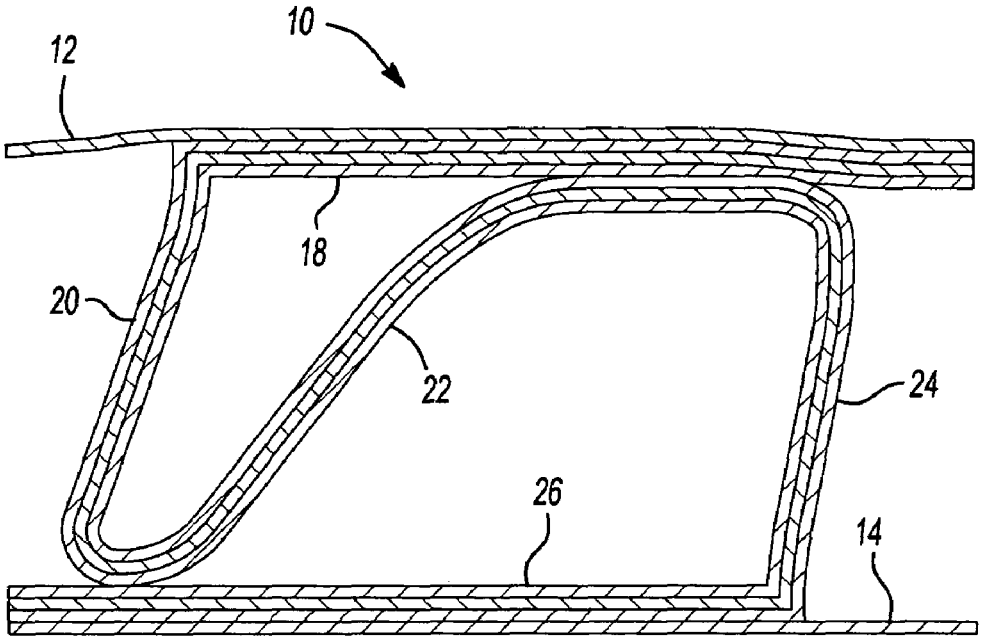
FIG. 9 is a cross-sectional view of one web of the blast reducing structure in a collapsed configuration having no liquid.
Figure 10:
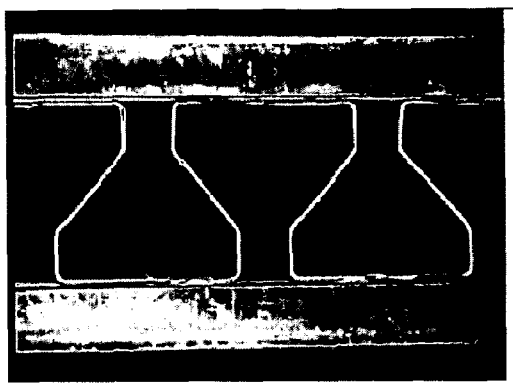
FIGS. 10(*a*)-(*f*) are a series of photographs illustrating the collapse mechanism of a blast reducing structure having no liquid.
Figure 10:
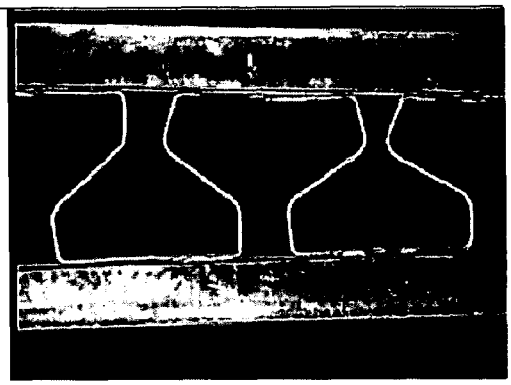
Figure 10:
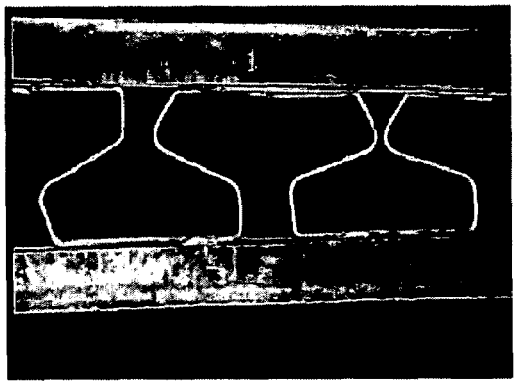
Figure 10:
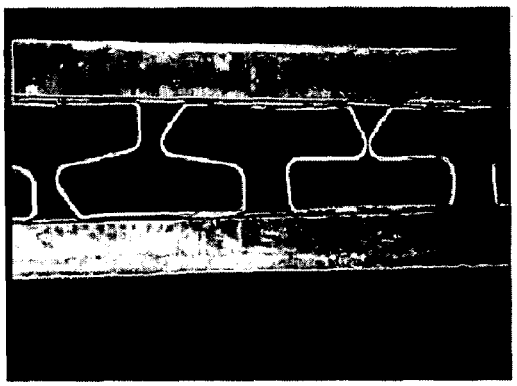
Figure 10:
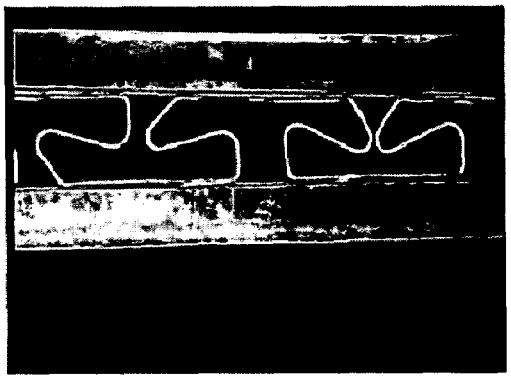
Figure 10:
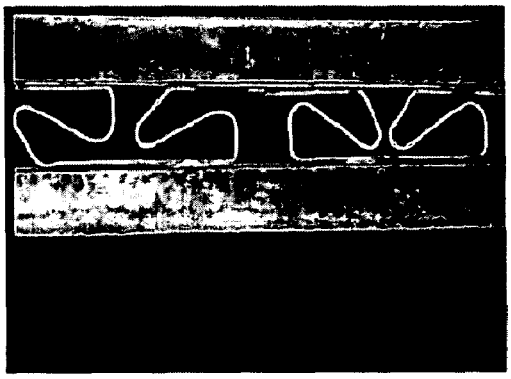

The collapse mechanisms of a web and a panel without liquid are illustrated in FIGS. 9 and 10(*a*)-(*f*) under quasi-static conditions using a panel made from 0.159 cm. (1/16 in.) mild steel, 7.62 m. (3 in.) deep. Designs were based on establishing fairly constant force deformation curves such that energy could be maximized for a given collapse force. Three test specimens were made and compressed to near-complete collapse. The collapse mechanisms of the web and cells and the resulting force-displacement curves are shown in FIGS. 9, 10(*a*)-(*f*) and 11.

Figure 11:
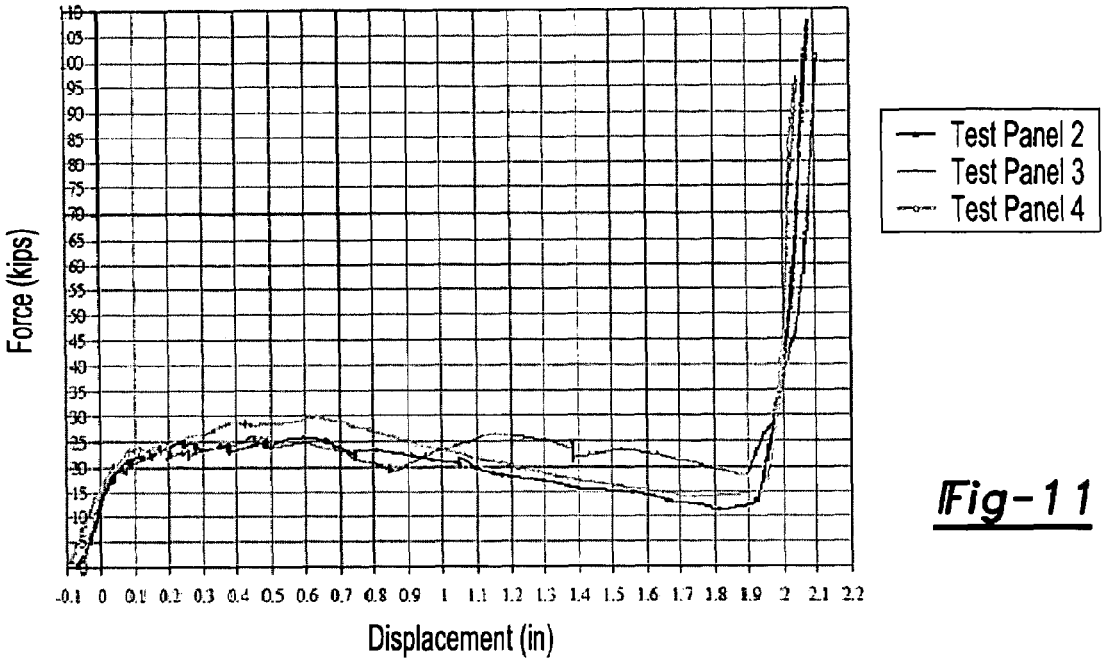
FIG. 11 is a graph illustrating the quasi-static force versus displacement of the blast reducing structure of FIG. 10 having no liquid.
Figure 12A:
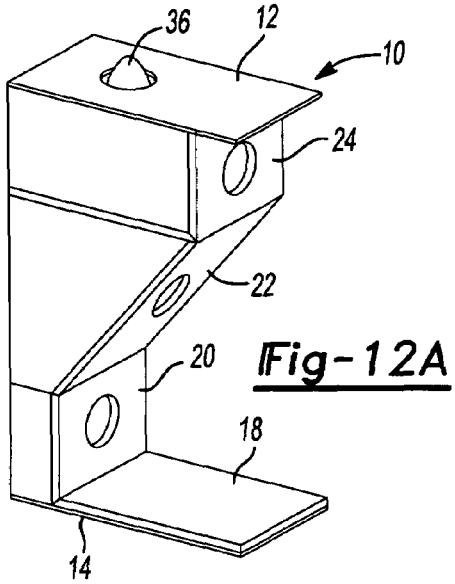
FIGS. 12(*a*)-(*j*) are a series of views illustrating liquid evacuation following impact in 0.15 msec intervals starting at 0.15 msec.
Figure 12B:
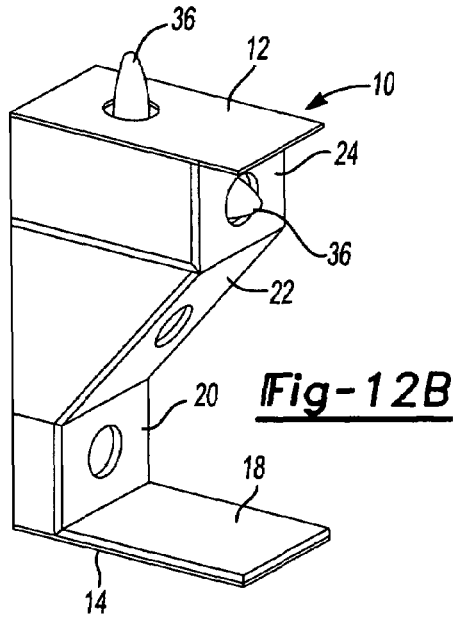
Figure 12C:
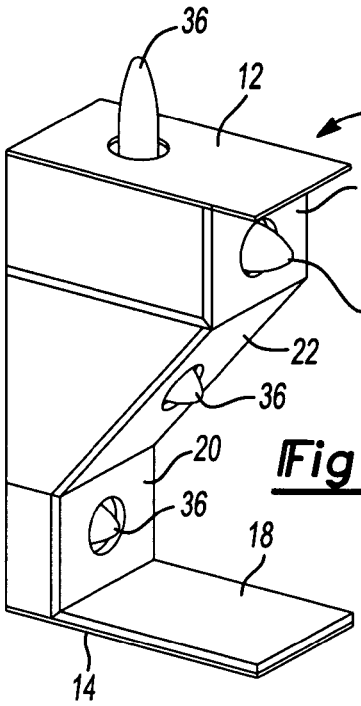
Figure 12D:
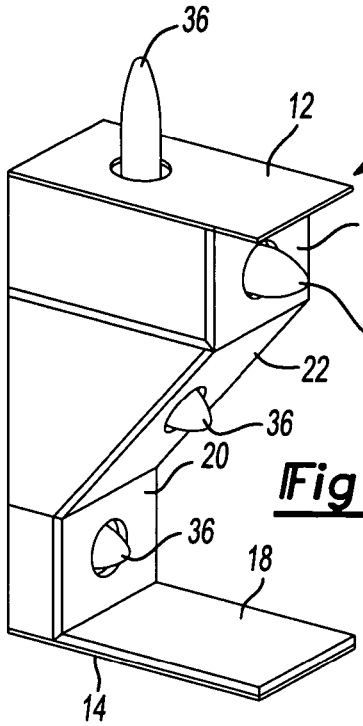
Figure 12E:
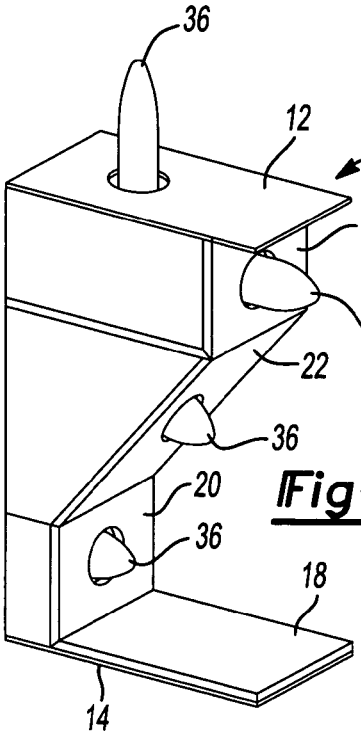
Figure 12F:
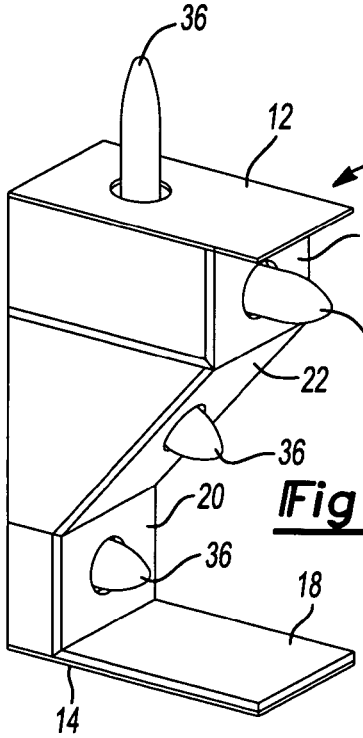
Figure 12G:
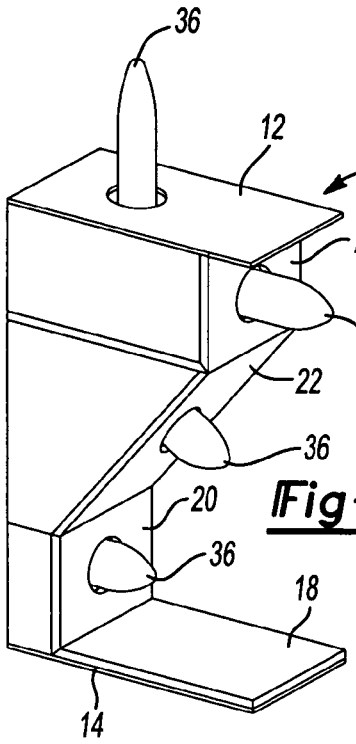
Figure 12H:
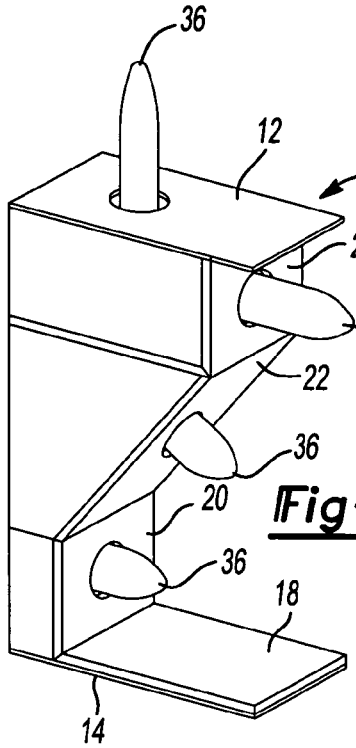
Figure 12I:
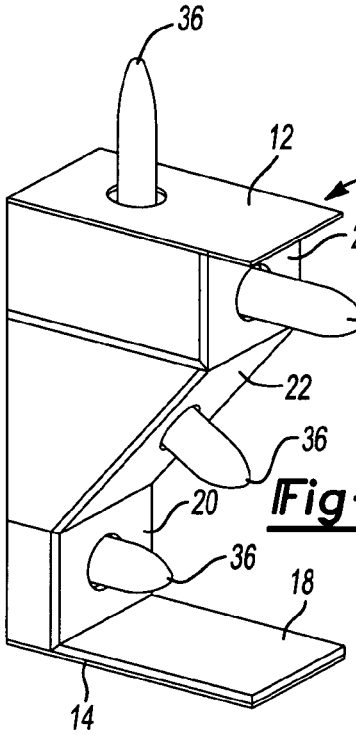
Figure 12J:
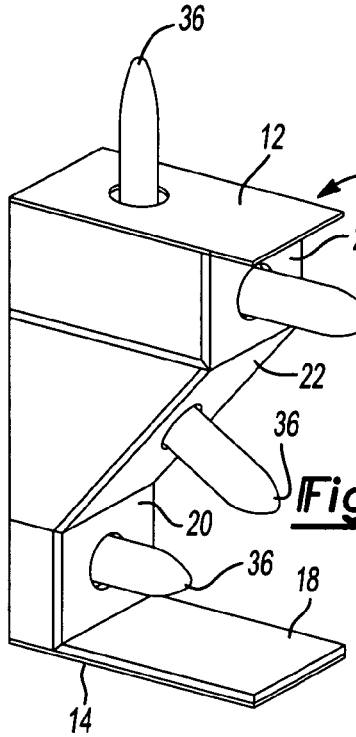

These results can be simulated using finite element analysis programs. Example simulations were conducted using the ABAQUS computer program and the results closely resembled experimental data. Note that as the stiffeners collapse such that contact is made with the bottom plating, substantial resistance forces develop, as shown in the test results (FIG. 11) at approximately 1.9 inches. It is also interesting and important to note that a plastic collapse mechanism for the stiffener that consists of plastic hinges forming at the top, bottom, and corners of the stiffener can provide a much-simplified analysis. The upper bound of plastic limit analysis can then be applied to predict the collapse force by equating the rate of external work to the rate of internal (plastic) energy dissipation. This approach was in fact the approach used to design the structural system for quasi-static collapse. This also proves important for developing the analytic solution for the dynamic collapse of the system with and without liquid for the blast cases discussed in the following.

In a preliminary study to investigate the effects of encasing liquid within alternating cells of blast reducing structure 10, the ABAQUS computer package was used to simulate the response of one-half (½) of a single cell with symmetry conditions imposed on both sides. The geometry of the half cell walls is illustrated in FIGS. 2 and 3-8. For this simulation study, aluminum alloy sheeting properties were used for the faceplates and web stiffener. A linearly varying (with time) pressure pulse was prescribed with an instantaneous peak pressure of 3.103 MPa and duration of one millisecond. This approximates the air blast effects of about 2.3 kg of TNT at 1.5 m. Simulations were carried out with a unit width of blast reducing structure 10 (perpendicular to the page). The analysis showed that without liquid the structure collapses within about one msec (see FIGS. 13 and 14) and a very large impulsive force is imparted to the supporting structure because of the impact of the collapsing core and upper panel with the bottom support.

The dynamics of the systems change dramatically (for the same blast conditions) with the presence of the liquid, in this case, water. For the particular arrangement with 1.0 inch periodicity "into the page" of our ⅜ inch holes through which the water escapes, a sequence of deformation stages is illustrated in FIG. 12. For this two-dimensional analysis, no flow is allowed perpendicular to the page across periodic boundaries; liquid flow through the holes is perpendicular to its area. The system is shown to be very highly "damped" and collapse of blast reducing structure 10 is prevented. Rather, sufficient kinetic energy is absorbed that the top plating reaches a peak downward displacement and then rebounds. This prevents the large damaging impulse to the supporting structure and offers a surprisingly beneficial blast mitigation effect.

Qualitatively, the system benefits considerably from the liquid because the momentum, imparted initially downward, develops horizontal and upward vertical components, reducing the momentum imparted downstream from the blast. Additionally, the liquid pressure at the top, acting upward on the top panel and resisting downward motion, is higher than the pressure at the bottom (and contributing to the impulsive forces acting on the supporting structure).

For a quantitative description of the dynamics, a theoretical model of a liquid-structure interaction system is provided. The model considers the liquid field in terms of three volume components, associated respectively with: 1) the top rectangular (cross-section) area, 2) the central funnel shaped area, and 3) the bottom smaller rectangular area. The collapse mechanism of the core is essentially very similar (initially) to that described earlier for the quasi-static analysis (See FIG. 10). Thus, the loss in volume of the liquid is approximately that of the loss of the funnel area times the unit width of blast reducing structure 10. The average vertical displacement (positive downward) of the top panel is denoted by X. To first order of approximation, one can assume that the sum of the top and bottom volumes is unchanged and the center volume is changed by a reduction in height, equal to the change in height of the core, caused by a rotation of the diagonal section of the core web stiffener. This approximation is fairly accurate and greatly facilitates an appreciation and analysis of the dynamic response. The time rate of change of volume of the cell is thus proportional to the top panel velocity:

$$\dot{V}=A\dot{X} \tag{1}$$

where A is a constant, the cross-sectional funnel width times the unit depth.

With the presumed incompressibility of the liquid, the loss in volume associated with the reduction of funnel area causes the development of pressure, flow from the funnel area to the top and bottom rectangular areas, and flow from the holes provided in the core cell walls. Initially, there is negligible flow from the hole in the diagonal cell wall due to lack of interface pressure because the average vertical velocity of the funnel liquid area and cell wall are both (approximately) equal to one half the vertical velocity of the top panel. (These kinematic approximations result from treating the cell walls as rigid-perfectly plastic with plastic hinges forming at the corners of the web stiffeners). Also to the first order of approximation, the average velocity of the top rectangular liquid area is equal to the velocity of the top panel and the velocity of the bottom rectangular liquid area is zero.

The upper components of the system rapidly accelerate (downward in the figure) upon arrival of the air blast wave; however the initial accelerations are significantly reduced by the presence of the mass of the liquid. The change in volume of the remaining liquid is forced by the change in geometry of the core as the top plating deflects downward relative to the bottom support. The resulting pressures cause liquid flow from the top and side holes. From Bernoulli's equation (recognizing the limitations of this equation), the liquid pressures and the flow velocities can be related by, for example:

$$v_1^2=2p_1/\rho \text{ and } v_2^2=2p_2/\rho+v_{2i}^2 \tag{2}$$

where ρ is the liquid mass density, $v_1$ and $p_1$ are the liquid flow relative velocity from the top hole and the pressure respectively at the top of the cavity; $v_2$ and $p_2$ are the liquid flow velocity and bottom pressure of the top rectangular liquid section; $v_{2i}$ is the flow velocity from the funnel section to the top section. The pressures between the liquid sections can also be related to the accelerations of the top panel. Expressing the mass and horizontal area of the top liquid section by $M_2$ and $A_2$ respectively, for example, results in:

$$p_2=p_1-(M_2/A_2)\ddot{X} \tag{3}$$

In this manner the liquid velocities at the holes, $v_1$, $v_2$ and $v_3$, can be related to the pressure at the top, $p_1$, the flow velocities between liquid sections $v_{2i}$ and $v_{3i}$, and the top panel acceleration, $\ddot{X}$. The average liquid velocity from the holes, $v_a$, can then be determined in terms of the collapse velocity, $\dot{X}$, from the continuity condition for liquid flow. The top liquid pressure is then found in terms of the top plate velocity and accelerations in the form:

$$p_1=(\tilde{M}/\tilde{A})\ddot{X}+\rho\gamma(A/A_w)^2\dot{X}^2 \quad (4)$$

The velocity coefficient is written in terms of the liquid density ρ a geometric factor, γ depending on the relative areas of liquid exit holes, the average horizontal funnel area, A, and the area of the holes, $A_w$. The acceleration coefficient is written in terms of the masses of the liquid sections and their respective horizontal cross-sections areas. The compressive force in the stiffener, $F_c$, can also be determined by considering equations of motion of the upper stiffener segment:

$$2F_c=F_0-A_kp_1+M_k\ddot{X} \quad (5)$$

In the above expression, $F_0$ is the static strength of the stiffener, $A_k$ is an effective area expressed solely in terms of stiffener geometry and $M_k$ is an effective mass written in terms of liquid segment and stiffener masses.

The equation of motion for the upper plate of mass $M_1$ with liquid contact area $A_1$ is:

$$(M_1+M_k)\ddot{X}=(F_i-F_0)-qt-p_1(A_1-A_k) \quad (6)$$

where $\ddot{X}$ is the position of the blast side of blast reducing structure 10 as a function of time, $F_i$ is the initial blast force on the top panel and q is the time rate of change of the blast force dissipation. Here we see the influence of the additional mass of the liquid, $M_k$, and the effect of the liquid pressure on reducing the stiffener's resistance, via $A_k$. Upon substitution of the expression above for the pressure $p_1$, we find a second order, nonlinear, ordinary differential equation for the top panel in the form:

$$M\ddot{X}+C\dot{X}^2+qt-F=0 \quad (7)$$

This is a form of the Ricatti equation and, through appropriate transformations, can be reduced to a first order ordinary differential equation that is linear with variable coefficients. It should be noted that the term $C\dot{X}^2$ is a damping term from the liquid dynamics and is proportional to the square of the velocity of the blast impulse. This indicates also that the benefit of the added liquid increases with increased velocity of the blast impulse. Solutions for the displacement can then be obtained in the form of Bessel and Modified Bessel functions of order ⅓ and −⅓.

Figure 13:
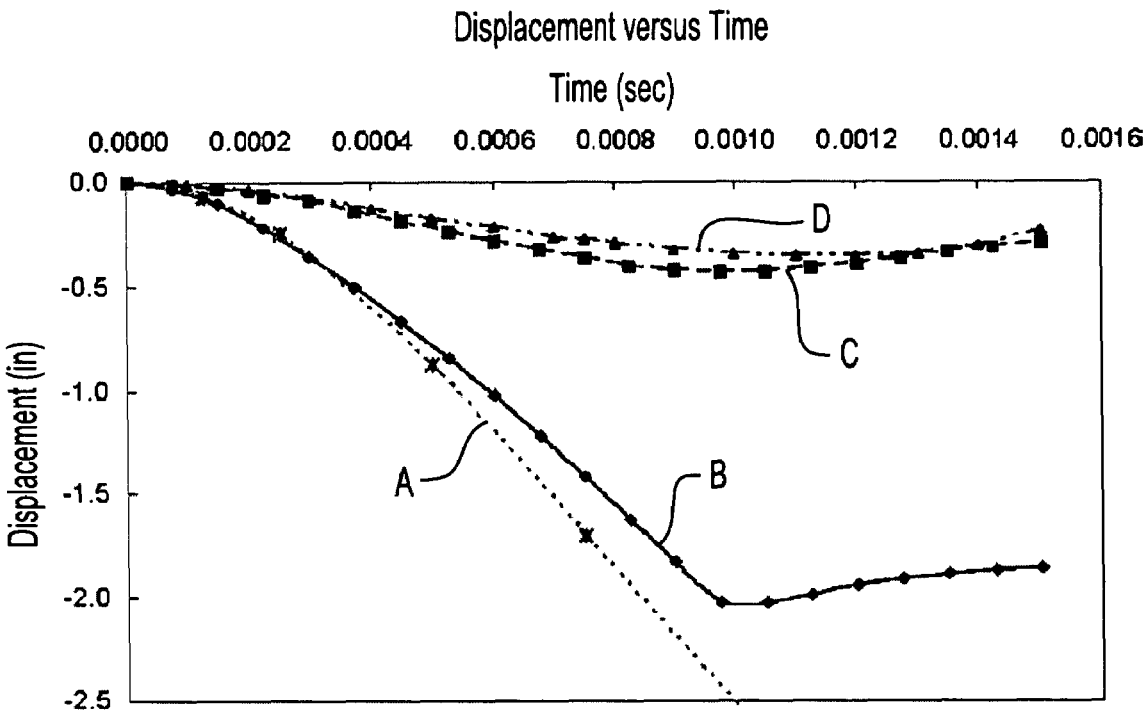
FIG. 13 is a graph illustrating the displacement versus time for blast-side displacement for analytic (Line A) and numeric (Line B) solutions without liquid and analytic (Line D) and numeric (Line C) solutions with liquid.

Solutions obtained in this manner are shown in FIG. 13 for cases with and without liquid encasement. Blast-side displacements are shown for the analytic (curve A) and numeric (curve B) solutions without liquid. Blast-side displacements are also shown for analytic (curve D) and numeric (curve C) solutions with liquid present. The solutions compare very well with the numerical simulations and support the conclusion that the presence of the liquid changes the dynamics and has remarkable benefit. It is noted that there is a limitation to the validity of the above analytical model because of the separation between the top plate and the liquid at about t=0.00075 sec. This demonstrates, however, that the combination of numerical and analytical results can be used to describe and understand the complex system dynamics, an understanding necessary for design of these systems.

Figure 14:
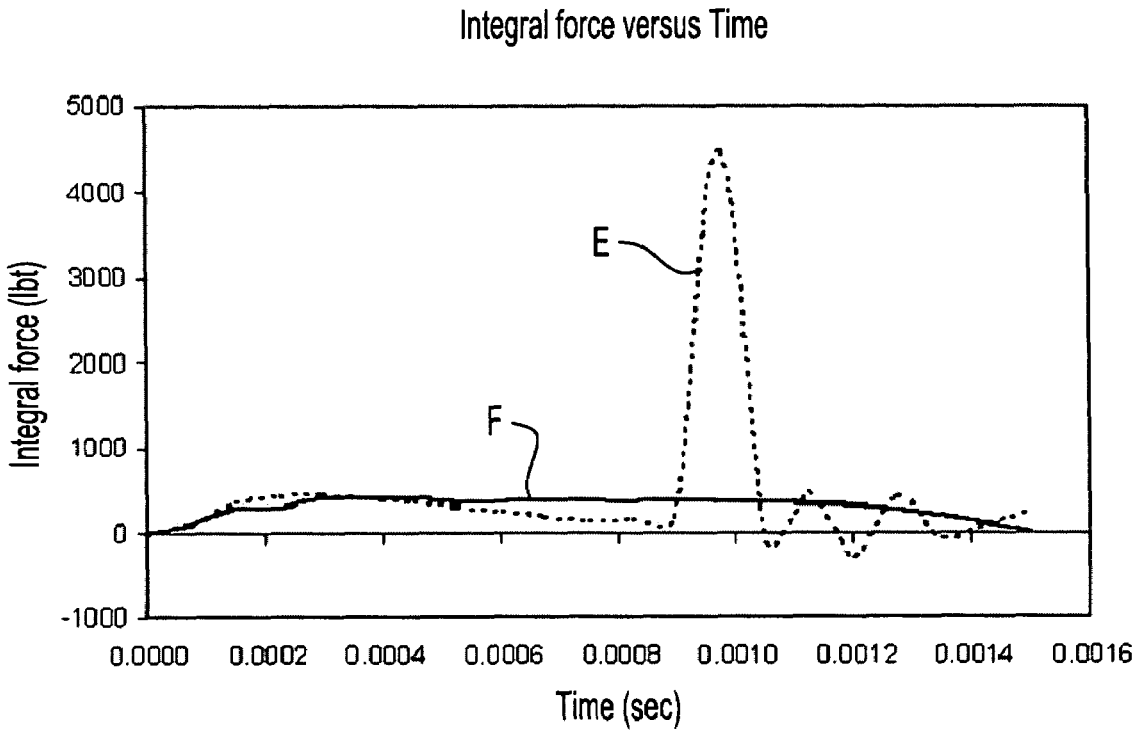
FIG. 14 is a graph illustrating the force versus time for no liquid (Line E) and liquid-filled (Line F) numeric solutions.

It should be appreciated that one of many advantages of the added liquid of the present teachings is the tremendous reduction in the integrated reaction force of the support, seen in FIG. 14. The force (integrated over the downstream blast panel area) is shown versus time for no liquid (curve E) and liquid-filled (curve F) panels as determined from the numeric solutions. This demonstrates that the design intended to reduce the transmission of impulse to the downstream structure is extremely successful for the prescribed blast conditions.

According to the principles of the present teachings, it has been found that blast reducing structure 10 thus benefits from the presence of the liquid in multiple ways. First, there are reduced accelerations due to the additional mass of the liquid. Secondly, the additional momentum of the mass of the liquid is not entirely transferred downstream because of the liquid flow from the system, thus the effective mass is diminished after it has provided its initial positive benefit and before the penalty of its momentum has to be accounted for by the downstream structure. Thirdly, there is a beneficial hydraulic effect whereby the net liquid force downstream (which is detrimental) is less than the liquid force acting upward on the top panel (which is helping support blast reducing structure 10) because the area of the bottom liquid section is smaller than the area of the top liquid section. Fourthly, there is a beneficial effect due to the viscous losses associated with the flow.

The description of the teachings is merely exemplary in nature and, thus, variations that do not depart from the gist of the teachings are intended to be within the scope of the invention. Such variations are not to be regarded as a departure from the spirit and scope of the teachings.

What is claimed is:

1. A blast reducing structure comprising:

a first web and a second web, each of said webs having a first section defining a first plane, a second section defining a second plane, said second plane being generally parallel to said first plane, an interconnecting section interconnecting said first section to said second section, said first web being disposed in mirrored relationship to said second web to define a volume;

an energy absorbing liquid being disposed in said volume; and an aperture formed in at least one of said first section, said second section, and said interconnecting section and in fluid communication with said volume permitting said energy absorbing liquid to pass therethrough in response to an impact in a direction orthogonal to a direction of said impact, wherein said first section, said second section, and said interconnecting section cooperating to collapse in response to the impact, thereby dissipating force associated with the impact, said energy absorbing liquid further frictionally and viscously dissipating said force associated with the impact.

2. The blast reducing structure according to claim 1, further comprising:

a third section interconnecting said interconnecting section with said first section, said third section defining a third plane being generally perpendicular to said first section; and a fourth section interconnecting said interconnecting section with said second section, said fourth section defining a fourth plane being generally perpendicular to said second section.

3. The blast reducing structure according to claim 2 wherein said first section and said second section are each about 1.5 inches long, said third section and said fourth section are each about $^{13}/_{16}{}^{th}$ inch long, and said interconnecting section is about 1.82 inches long.

4. The blast reducing structure according to claim 3 wherein an angle between said interconnecting section and said third section is about 40 degrees.

5. The blast reducing structure according to claim 1, further comprising:

a member sealing said aperture to prevent flow of said energy absorbing liquid through said aperture prior to the impact.

6. The blast reducing structure according to claim 5 wherein said member is a seal selected from the group consisting essentially of a grommet, a membrane bladder, a tape and a plug.

7. The blast reducing structure according to claim 1, further comprising:

an aperture formed in at least one of said first section, said second section, and said interconnecting section to permit said energy absorbing liquid to pass therethrough in response to said impact pulse.

8. The blast reducing structure according to claim 7, further comprising:

a member sealing said aperture to prevent flow of said energy absorbing liquid through said aperture prior to said impact pulse, said member being a seal selected from the group consisting essentially of a grommet, a membrane bladder, a tape and a plug.

9. The blast reducing structure according to claim 1 wherein said volume defines an upper portion that initially reduces in volume in response to said impact pulse.

10. The blast reducing structure according to claim 1 wherein said energy absorbing liquid is chosen from the group consisting essentially of water, water with water additives to increase density and viscosity, polydimethylsiloxane (PDMS), water and glycerine mixtures, and granular materials that flow.

11. A blast reducing structure comprising:

a plurality of blast reducing webs, each of said plurality of blast reducing webs having a first web and a second web, each of said webs having a first section defining a first plane, a second section defining a second plane, said second plane being generally parallel to said first plane, an interconnecting section interconnecting said first section to said second section, said first web being disposed in mirrored relationship to said second web to define a plurality of discrete and fluidly independent volumes;

an energy absorbing liquid being disposed in alternating ones of said plurality of discrete and fluidly independent volumes; and a selectively sealable aperture formed in at least one of said first section, said second section, and said interconnecting section permitting fluid communication between adjacent ones of said plurality of discrete and fluidly independent volumes, said selectively sealable aperture permitting said energy absorbing liquid to pass therethrough in response to an impact in a direction orthogonal to a direction of said impact, wherein said first section, said second section, and said interconnecting section cooperating to collapse in response to the impact, thereby dissipating force associated with the impact, said energy absorbing liquid further dissipating said force associated with the impact.

12. The blast reducing structure according to claim 11, further comprising:

a third section being disposed between and interconnecting said interconnecting section with said first section, said third section defining a third plane being generally perpendicular to said first section; and a fourth section being disposed between and interconnecting said interconnecting section with said second section, said fourth section defining a fourth plane being generally perpendicular to said second section.

13. The blast reducing structure according to claim 12 wherein said first section and said second section are each about 1.5 inches long, said third section and said fourth section are each about $^{13}/_{16}{}^{th}$ inch long, and said interconnecting section is about 1.82 inches long.

14. The blast reducing structure according to claim 13 wherein an angle between said interconnecting section and said third section is about 40 degrees.

15. The blast reducing structure according to claim 12, further comprising:

an aperture formed in at least one of said first section, said second section, said third section, said fourth section, and said interconnecting section to permit said energy absorbing liquid to pass therethrough in response to said impact pulse.

16. The blast reducing structure according to claim 15, further comprising:

a member sealing said aperture to prevent flow of said energy absorbing liquid through said aperture prior to said impact pulse.

17. The blast reducing structure according to claim 16 wherein said member is a seal selected from the group consisting essentially of a grommet, a membrane bladder, a tape and a plug.

18. The blast reducing structure according to claim 11, further comprising:

a member sealing said aperture to prevent flow of said energy absorbing liquid through said aperture prior to said impact pulse, said member being a seal selected from the group consisting essentially of a grommet, a membrane bladder, a tape and a plug.

19. The blast reducing structure according to claim 11 wherein said fluidly independent volumes defines an upper portion that initially reduces in volume in response to said impact pulse.

20. The blast reducing structure according to claim 11 wherein said energy absorbing liquid is chosen from the group consisting essentially of water, water with water additives to increase density and viscosity, polydimethylsiloxane (PDMS), water and glycerine mixtures, and granular materials that flow.

21. The blast reducing structure according to claim 11 wherein said energy absorbing liquid is disposed in alternating ones of said plurality of discrete and fluidly independent volumes.

* * * * *

UNITED STATES PATENT AND TRADEMARK OFFICE

CERTIFICATE OF CORRECTION

PATENT NO. : 7,575,797 B2
APPLICATION NO. : 11/211367
DATED : August 25, 2005
INVENTOR(S) : Dale Karr and Marc Perlin It is certified that error appears in the above-identified patent and that said Letters Patent is hereby corrected as shown below:

Column 6, line 67, "angular" should be --angle--.

Column 7, line 7, "filled is liquid" should be --filled with liquid--.

Signed and Sealed this

Sixth Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,575,797 B2
APPLICATION NO. : 11/211367
DATED : August 18, 2009
INVENTOR(S) : Karr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1028 days.

Signed and Sealed this

Seventh Day of September, 2010

David J. Kappos

David J. Kappos
*Director of the United States Patent and Trademark Office*